United States Patent [19]

Clark et al.

[11] Patent Number: 4,761,306

[45] Date of Patent: Aug. 2, 1988

[54] METHOD OF MAKING A POSITIONED CHIP SURFACE COVERING

[75] Inventors: Lawrence Clark; Harold N. Graybeal; Jack H. Witman, all of Lancaster, Pa.

[73] Assignee: Armstrong World Industries, Inc., Lancaster, Pa.

[21] Appl. No.: 666,295

[22] Filed: Oct. 30, 1984

[51] Int. Cl.[4] ..... B05D 5/00

[52] U.S. Cl. ..... 427/197; 156/63; 156/276; 156/279; 156/315; 427/201; 427/202; 428/143; 428/207; 428/323

[58] Field of Search ..... 427/197, 202, 201; 428/143, 323, 207; 156/63, 279, 276, 315

[56] References Cited

U.S. PATENT DOCUMENTS 4,292,394 9/1981 Chu et al. ..... 427/197

FOREIGN PATENT DOCUMENTS 22111 of 1909 United Kingdom ..... 427/197

*Primary Examiner*—John J. Gallagher

[57] ABSTRACT

The present invention relates to a process for preparing chip-containing decorative surfaces wherein the chips are positioned so as to provide a pattern. A first adhesive material is selectively applied to a support surface and the conditions are adjusted so that the first adhesive material is substantially non-adhesive in nature. A second adhesive material is selectively applied as a pattern on top of or adjacent to the first adhesive material and chips are applied to the surface so as to be adhered by the second adhesive material. Any non-adhered chips are removed and the conditons are adjusted so that the first adhesive material demonstrates adhesive properties. A second type or color of chip material is then applied so as to be adhered by the first adhesive material. Upon removal of the non-adhered chips, a product is obtained having a positioned chip pattern. The process may also be practiced using additional adhesives and chips so as to provide products having more than two types of positioned chips.

1 Claim, No Drawings

METHOD OF MAKING A POSITIONED CHIP SURFACE COVERING

The present invention relates to decorative surfaces, and more particularly, to decorative surfaces comprising positioned chip patterns.

BACKGROUND OF THE INVENTION

Decorative surface coverings are in wide use and may be obtained by highly varied techniques. Of particular interest are decorative surface coverings comprising chips wherein the chips are applied either randomly or in patterns. Methods currently known in the art include the embedding of chips in a plastic matrix whereby the resulting structure may be used as wall and floor coverings.

PRIOR ACT

A number of references disclose the embedding of particulate materials in plastic matrices. Recently, U.S. Pat. No. 4,440,826 described an invention where translucent or transparent chips were embedded in a thermoplastic material such that the chips served as windows onto an underlying pattern, thereby providing unique visual properties. Also of interest are several references which were cited during prosecution of the '826 patent. These are U.S. Pat. No. 4,054,699 which describes a way of providing a chip-containing tile pattern; U.S. Pat. No. 3,749,629 which discloses a way of making a decorative laminate by adhering chips to an adhesive material; and U.S. Pat. No. 3,265,548 which describes a process for preparing a decorative surface covering by depositing colored granules on a liquid coating and heating and planishing the layered material. Other references are also of interest such as U.S. Pat. Nos. 3,540,974 and 3,700,514, both of which relate to other methods of preparing embedded chip products.

Despite the substantial effort which has been directed to the inventing of new and different processes for the preparation of chip-containing materials, no methods presently exist for the preparation of chip-containing products wherein different chips may be applied conveniently in a pattern.

Accordingly, one objective of the present invention is to provide a method for preparing chip-containing products wherein the products comprise a pattern having more than one type of chip material contained therein.

This and other advantages of the present invention will become apparent from the detailed description of preferred embodiments which follow.

SUMMARY OF THE INVENTION

The present invention relates to a process for preparing chip-containing decorative surfaces wherein the chips are positioned so as to provide a pattern. A first adhesive material is selectively applied to a support surface and the conditions are adjusted so that the first adhesive material is substantially non-adhesive in nature. A second adhesive material is selectively applied as a pattern on top of or adjacent to the first adhesive material and chips are applied to the surface so as to be adhered by the second adhesive material. Any non-adhered chips are removed and the conditions are adjusted so that the first adhesive material demonstrates adhesive properties. A second type or color of chip material is then applied so as to be adhered by the first adhesive material. Upon removal of the non-adhered chips, a product is obtained having a positioned chip pattern. The process may also be practiced using additional adhesives and chips so as to provide products having more than two types of positioned chips.

DETAILED DESCRIPTION OF PREFERRED EMBODIMENTS

In one embodiment, the present invention comprises a process of forming a decorative surface comprising decorative particles, said process comprising selectively providing at least two adhesive materials on a support surface, said adhesives optionally being applied on top of or adjacent to one another, and sequentially activating each adhesive material and sequentially applying different types of chip materials to said surface such that each adhesive type adheres substantially one chip type, non-adhered chips being removed after each chip application, whereby a product is produced comprising a pattern of adhered chips.

In a second embodiment, the present invention relates to a process for forming a decorative surface comprising decorative particles, said process comprising the steps of selectively providing a first adhesive material on a support surface; selecting a first set of environmental conditions such that said first material exhibits substantially non-adhesive properties; selectively providing a second adhesive material on said support surface, said second material being applied on top of and/or adjacent to said first material, said second material exhibiting adhesive properties under said first set of conditions; depositing a first decorative particulate material over the layered adhesive materials, at least a portion of said particulate material being adhered to said second material; removing non-adhered particles from the surface of the layered composite; selecting a second set of environmental conditions such that said first adhesive material exhibits adhesive properties; depositing a second decorative particulate material over the surface of the layered composite, at least a portion of said second particulate material being adhered to said first adhesive material; and removing non-adhered particles from the surface of the layered composite.

The present invention is practiced by selecting adhesive materials which demonstrate adhesive properties under different environmental conditions. Thus, a first adhesive material is applied to all or part of a support surface, and the conditions are adjusted such that this first-applied material is substantially non-adhesive. This may be achieved by evaporating a solvent from the first-applied material, or by other means well known to the artisan. The first adhesive may be applied to the support surface by means well known in the art such as roll coating, curtain coating and the like.

A second adhesive material is selectively applied over the surface of the first adhesive material, or adjacent to the first material, so as to provide a desired pattern. Various methods of applying the pattern are also known in the art, examples being rotogravure printing, screen printing, flexographic printing and the like. The first chip material is then applied to the surface of the layered materials so that the chips will be adhered by the tacky second adhesive. Essentially no chips will be held by the first-applied adhesive material because the conditions have been adjusted such that that adhesive is non-tacky. The determination of suitable tackiness is well within the capabilities of an ordinary artisan. Thus, an artisan may use trial and error, or instrumental means may be used, such as by making measurements using a Zapon testing device.

After the first chips have been applied and the non-adhered chips have been removed, the conditions are readjusted by heating or by solvent treatment to cause the first adhesive material to become tacky. A second type or color of decorative chip is applied over the surface of the composition so as to be adhered to the first adhesive material. Excess chips are then removed so as to provide a positioned two-chip pattern. Depending upon the use intended by the artisan, this structure may be used as is, or it may be further over-coated with a wear coating material, such as a plastisol or chips which will eventually provide a structure in which the chip pattern is clearly visible, but which is suitable for use as a wear surface.

The first-applied adhesive must be a material which can assume a non-adhesive state under the first set of environmental conditions, but which can be heat-activated to become adhesive under the second set of environmental conditions. Typically it will be a thermoplastic material. The last-applied adhesive can be either a thermoplastic or thermoset material since it would be used immediately to adhere the first applied chips. Of course, if three or more types of chips are applied in a sequential pattern, the intermediately applied adhesives should be activatable by heat or solvent treatment so that they can be activated in a sequential manner under appropriate conditions. Typically, these materials will also be thermoplastic in nature. It is also noted that a coating of a material which is non-adhesive under the conditions of use may be selectively applied to a support along with the above-described adhesive materials. Such "non-adhesive" materials will have no ability to adhere the chip materials to the support surface under the various conditions selected; thus, regions free of chips will be obtained.

Essentially any type of thermoset or thermoplastic materials may be utilized, subject to the considerations set forth above. For example, homo- and co-polymeric acrylate and methacrylate adhesive compositions, acrylic and methacrylic resins, polyester resins, styrene-based polymers, toluenesulfonamideformaldehyde resins, vinyl resin compositions and the like may be used to provide adhesive compositions having desired properties. In essence, the objective will be to utilize materials which provide differential adhesive properties under the selected processing condition.

A preferable way to practice the invention is to provide as the first adhesive material a thermoplastic material which is solvent diluted and which will be substantially non-tacky at room temperature. Thus, when the adhesive is applied and the solvent is evaporated, a relatively non-tacky surface is obtained. This surface may be readily printed with a pattern of a second adhesive or potentially adhesive material by any means suitable to the artisan. Ideally, this last-applied adhesive material will be a plastisol ink which is tacky under ambient conditions; nevertheless, other low-melting thermoplastic materials or thermoset materials may be used as the second adhesive material. For thermoplastic materials, the only requirement is that these materials be lower-melting than the first-applied adhesive material.

The chips which may be used to practice the invention are well known in the art. For example, silica chips, quartz chips and many other inorganic chips may be used to provide a visual effect. In addition, polymeric organic materials such as polyvinyl chloride may also be selected provided that they are amenable to the processing conditions which are selected. Further, natural materials such as wood chips, vegetable shell chips, and the like may be used to advantage.

The advantages of the present invention will become more apparent by reference to the examples which follow, said examples being provided by way of illustration and not limitation.

EXAMPLES

EXAMPLE 1

Thermoplastic compositions were prepared having the following components:

| Components (by weight) | Sample Number 1a | 1b | 1c | 1d | 1e | 1f | 1g |
|---|---|---|---|---|---|---|---|
| polymethyl methacrylate adhesive (Acryloid A-102; 40% solids from Rohm & Haas) | | | 100 | 72 | | | |
| polyacrylate adhesive (Acryloid B-44 from Rohm & Haas) | 40 | 33 | | 43 | | | |
| toluenesulfonamide-formaldehyde resin (Santolite MHP from Monsanto) | | 11 | | | | 8 | 12 |
| acrylic copolymer resin (Elvacite 2041 from du Pont) | | | | | 25 | | |
| acrylic copolymer resin (Elvacite 2013 from du Pont) | | | | | | 12 | 12 |
| vinyl resin (VYFS from Union Carbide) | | | | | | 12 | 12 |
| dioctyl phthalate plasticizer | | | 16 | | | | |
| methyl ethyl ketone | 42 | 42 | 22 | 60 | 105 | 34 | 32 |
| toluene | 18 | 18 | 22 | 60 | | 17 | 16 |
| butyl benzyl phthalate plasticizer (S-160 from Monsanto) | | | | | 25 | | |
| denatured alcohol | | | | | | 17 | 16 |
| approximate tackiness temperature (°F.) | <200 | <200 | 300 | 200 | 300 | 250 | 200 |

The approximate tackiness temperatures for each of the above resins was determined by casting solutions of each resin on glass plates and then selectively heating to desired temperatures. The chips were applied to the heated plates, allowed to stand for a brief period of time and excess or non-adhering chips were dumped off. Temperature testing was conducted up to approximately 300° F. Each of the above examples was found to exhibit suitable tackiness at (or below) the indicated temperature.

EXAMPLE 2

This example will illustrate the preparation of a two-chip pattern. A solution of sample 1c was applied by roll coater at an approximate thickness of 2–3 mils (wet) to a gelled plastisol substrate. The coating was dried and the surface of the coating was printed with a design using a rotary screen printer and the following plastisol ink composition.

| Components | | Parts by Weight | |
|---|---|---|---|
| PVC Resins | | | |
| Formalon NV-2 (Formosa Plastics) | | 29.5 | |
| Tenneco 1755 | | 35.2 | |
| Geon 173 (B. F. Goodrich) | | 32.3 | |
| Borden 260-SS | | 3.0 | |
| | Total | | 100.0 |
| Plasticizers | | | |
| Dioctyl phthalate | | 16.5 | |
| Texanol isobutyrate | | 21.3 | |
| Butyl benzyl phthalate | | 12.2 | |
| | Total | | 50.0 |
| Stabilizers | | | |
| Drapex 4.4 (Argus Chem. Co.) | | 3.0 | |
| Zinc oxide | | 0.2 | |
| Barium neodecanoate | | 0.4 | |
| | Total | | 3.6 |
| Diluent | | | |
| Jayflex 210 (Exxon Chemical) | | 5.0 | |
| | Total | | 5.0 |
| Pigment Dispersion | | | |
| Titanium dioxide/dioctyl phthalate (1:1) | | 7.5 | |
| | Total | | 7.5 |
| | | | 166.1 |

The plastisol ink exhibited the ability to hold chips whereas the first-applied coating 1c did not. Vinyl chips were applied to the entire sheet and those chips not adhering to the wet plastisol ink were removed. Heat was applied to gel the plastisol and firmly adhere the chips. The sheet was then heated to approximately 300° F. and chips of a different color blend were applied. The sheet was cooled and excess chips were removed to provide a layered material having a two-colored pattern of chips.

EXAMPLE 3

This example will illustrate the preparation of a composite comprising three adhesive materials and two chip types. Compositions were prepared as follows:

| Components (by weight) | Sample Number 3a | Sample Number 3b |
|---|---|---|
| Vinyl solution, 22% solids (Plastoprint 5-Q-211 from Del-Val Ink & Color) | 76.0 | — |
| Acrylic copolymer resin (Elvacite 2013 from duPont) | 17.5 | — |
| Cellulose acetate propionate (CAP-482-0.5 from Eastman Chemical) | — | 30.0 |
| Polymethyl methacrylate adhesive (Acryloid A-21-LV; 30% solids from Rohm & Haas) | — | 26.6 |
| Wetting agent (Triton X-100 from Rohm & Haas) | — | 0.5 |
| Solvent blend (toluol 63%; denatured alcohol 20%; cellosolve acetate 7%) | 56.4 | 143 |

A gelled plastisol support surface was selected and a 1-mil coating of sample 3b was applied to a portion of the surface. A similar 1-mil coating of sample 3a was applied to a portion of the support surface such that none of this sample was applied over sample 3b. Finally, a clear plasitsol ink having the formula set forth in Example 2 (excluding the pigment) was applied to the remaining uncoated portions of the support surface. The solvent was permitted to evaporate from the 3a and 3b portions of the surface, leaving only the plastisol ink-coated portions in a wet condition.

Multi-colored PVC chips were applied to the entire surface and excess chips were removed, leaving chips adhered only to the ink-coated portions of the surface. The partially coated composite was heated at 250° F. for two minutes to gel the plastisol and to activate thermoplastic ink 3a. While hot, the structure was covered with vinyl chips having a different color, and excess chips were removed. This resulted in a final structure in which different colored chips were adhered to the sample 3a-coated and plastisol ink-coated portions of the composite, but in which no chips were adhered to the sample 3b-coated portions of the surface.

It is noted that the above procedure may be performed by using pressure to consolidate the chips into the receiving portion of the surface; however, brushing may be necessary in this case to overcome some minimal, but unwanted, adherence of the chips to other portions of the surface. Furthermore, comparable structures may be prepared in which sample 3b is replaced by a somewhat lower-melting material so that 3-chip patterns are produced.

The present invention is not restricted solely to the descriptions and illustrations provided above, but encompasses all modifications envisaged by the following claims.

WHAT IS CLAIMED IS:

1. A process for forming a decorative surface "comprising decorative particles"; comprising the steps of selectively providing a first adhesive material on a support surface;

selecting a first set of environmental conditions such that said first material exhibits substantially non-adhesive properties;

selectively providing a second adhesive material on said support surface, said second material being applied on top of and/or adjacent to said first material, said second material exhibiting adhesive properties under said first conditions;

depositing a first decorative particulate chip material over the layered adhesive materials, at least a portion of said particulate material being adhered to said second material;

removing non-adhered particles from the surface of the layered composite;

selecting a second set of environmental conditions such that said first adhesive material exhibits adhesive properties;

depositing a second decorative particulate chip material different from the first over the surface of the layered composite, at least a portion of said second particulate material being adhered to said first adhesive material; and removing non-adhered particles from the surface of the layered composite, whereby a product is produced comprising a pattern of adhered chips.

* * * * *